United States Patent [19]

Lalonde

[11] 4,222,547

[45] Sep. 16, 1980

[54] ICE TRAY

[76] Inventor: Michael G. Lalonde, 3 Fuller Ave., Leamington, Ontario, Canada, N8H 3S2

[21] Appl. No.: 2,967

[22] Filed: Jan. 12, 1979

Related U.S. Application Data

[63] Continuation-in-part of Ser. No. 660,239, Feb. 23, 1976, abandoned.

[51] Int. Cl.[3] ..... F25C 1/24

[52] U.S. Cl. ..... 249/120; 249/126; 249/127; 249/141; 249/154

[58] Field of Search ..... 249/69-73, 249/76, 119-121, 126-134

[56] References Cited

U.S. PATENT DOCUMENTS

| | | | |
|---|---|---|---|
| 1,889,481 | 11/1932 | Kennedy | 249/130 |
| 2,269,642 | 1/1942 | Zerk | 249/121 |
| 2,481,525 | 9/1949 | Mott | 249/127 |
| 2,537,915 | 1/1951 | Roop | 249/134 |
| 2,591,261 | 4/1952 | Holahan | 249/133 |
| 2,796,742 | 6/1957 | Platt | 249/127 |
| 2,810,338 | 10/1957 | Dawson | 249/133 |
| 3,021,695 | 2/1962 | Voigtmann | 249/127 |
| 3,120,112 | 2/1964 | Davis | 249/127 |
| 3,122,898 | 3/1964 | Kniffin | 249/127 |
| 3,214,128 | 10/1965 | Beck et al. | 249/127 |
| 3,317,177 | 5/1967 | Brand | 249/119 |
| 4,148,457 | 4/1979 | Gurbin | 249/127 |

*Primary Examiner*—Paul Lieberman
*Assistant Examiner*—Arthur H. Koeckert
*Attorney, Agent, or Firm*—Whittemore, Hulbert & Belknap

[57] ABSTRACT

An ice tray having specially shaped cavities for allowing individual ice pieces to be removed on a one-at-a-time basis in which each individual cavity has a uniformly curved bottom wall of part-circular configuration preferably part-cylindrical and a pair of generally concave opposed side walls of generally part-conical configuration flanking said bottom wall whose central apices provide a pivot axis about which the ice piece rotates when pressure is applied to the end of the ice piece to slide same along the curved bottomwall for removal from the cavity, the upper sheet portion which joins each individual cavity together being resiliently twistable to loosen all of the ice pieces simultaneously, if desired, and legs on the underside may be provided with notches for engaging portions on the upper surface of another tray to facilitate compact tray stacking, one upon another, without tray slippage or interference with ice formation.

24 Claims, 7 Drawing Figures

FIG. 1
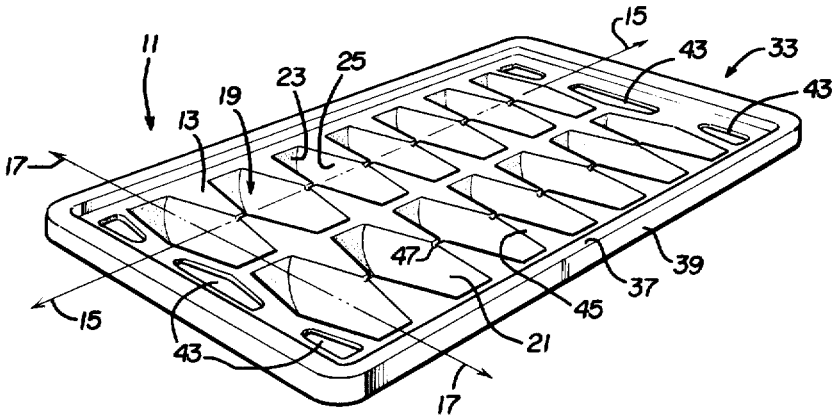
FIG. 3
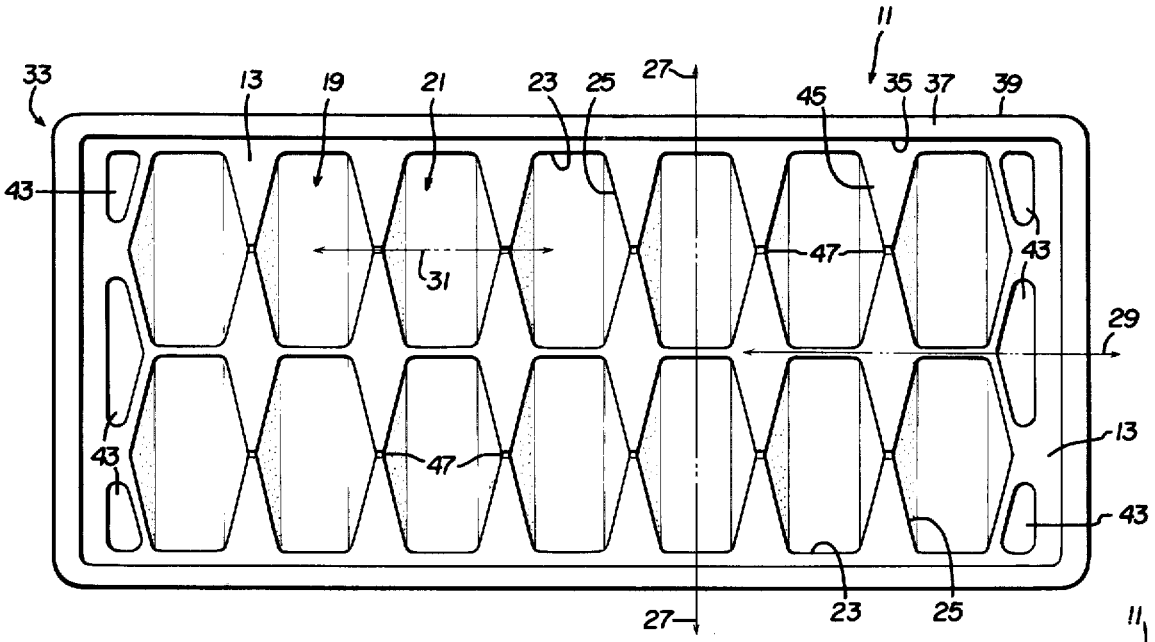
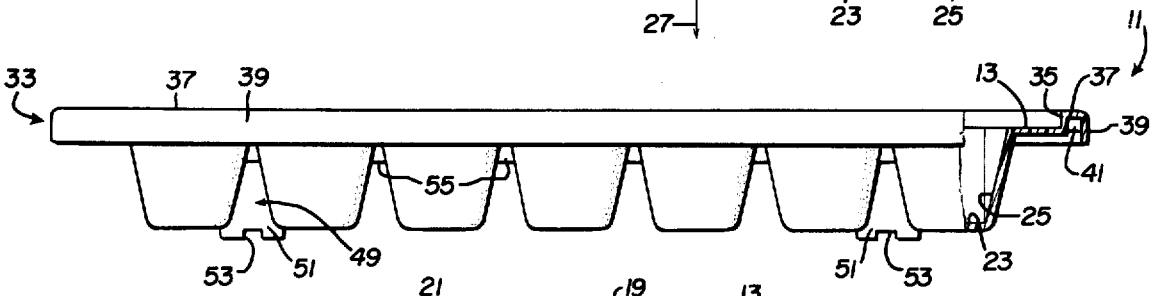
FIG. 2
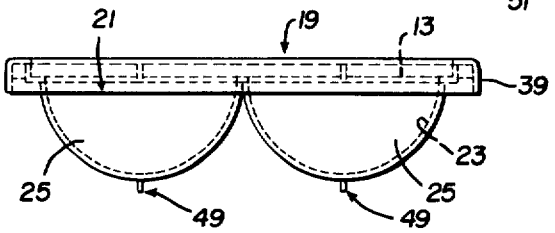
FIG. 4

ICE TRAY

CROSS REFERENCE TO RELATED APPLICATIONS

This application is a continuation-in-part of my copending application Ser. No. 660,239, filed Feb. 23, 1976, now abandoned.

BACKGROUND OF THE INVENTION

1. Field of the Invention

The present invention relates to an ice tray for producing pieces of ice and more particularly to an improved freezer tray providing a number of mould cavities for producing ice pieces individually.

2. Description of the Prior Art

Refrigerator ice cube trays often take the form of a substantially rectangular tray which is compartmentalized into a number of cavities in a variety of structures.

In one embodiment a mechanically displaceable partitioning structure is used so that subes can be mechanically cammed out of their cavities after the water has been frozen.

In another embodiment the ice cube tray takes the form of individual cells or cavities and in still other embodiments the ice cube tray includes the combination of a plurality of individual cells formed of a plastic material arranged in longitudinal rows and transversely aligned and united at their upper margins into an integral unit.

The following United States patents illustrate the variety of structures and shapes that have been developed:

U.S. Pat. No. 1,889,481 issued Nov. 29, 1932
U.S. Pat. No. 2,269,642 issued Jan. 13, 1942
U.S. Pat. No. 2,481,525 issued Sept. 13, 1949
U.S. Pat. No. 2,537,915 issued Jan. 9, 1951
U.S. Pat. No. 2,591,261 issued Apr. 1, 1952
U.S. Pat. No. 2,796,742 issued June 25, 1957
U.S. Pat. No. 2,810,338 issued Oct. 22, 1957
U.S. Pat. No. 3,021,695 issued Feb. 20, 1962
U.S. Pat. No. 3,120,112 issued Feb. 4, 1964
U.S. Pat. No. 3,122,898 issued Mar. 3, 1964
U.S. Pat. No. 3,214,128 issued Oct. 26, 1965
U.S. Pat. No. 3,317,177 issued May 2, 1967

It is an object of the invention to provide in an ice tray for forming a number of ice pieces or ice cubes as they are commonly called, the combination of a plurality of individual cavities formed from a resilient plastic material with each cavity open at the top and having resilient walls of relatively thin generally uniform thickness throughout their extent, said cavities being arranged in longitudinally and transversely aligned rows in spaced apart relation and being united at their upper margins or perimeters defining their open tops into an integral unit, each cavity having an internal configuration such that each has an axis of revolution lying substantially in the plane of its open top and defined by a central bottom wall of part-circular or part-cylindrical configuration flanked by spaced opposed generally part-conical side walls of opposite symmetry to thereby present a generally hexagonal perimetral configuration defining the top opening thereof, said cavity having a plane of symmetry extending substantially perpendicularly to the plane of the open top that includes the axis of revolution and the apices of the part-conical side walls and in which the dimension of each cavity measured in the plane of the top opening and in the direction of the axis of revolution is at a maximum in the region of the axis of revolution whereby moulded pieces of ice having a configuration imparted by each cavity can be easily displaced out of the top opening to the one side of the axis of revolution under the application of force to such moulded pieces of ice at the other side of the axis of revolution.

In conventional trays, once the water or other liquid freezes into ice, it is usually quite difficult to remove the ice cubes on a one-at-a-time individual basis. Generally, it is necessary to place the entire tray under flowing water to loosen all of the cubes from the pockets simultaneously so that all of the cubes are normally removed at the same time. Various complex mechanisms have been provided for loosening ice cubes, but these are often difficult to operate, particularly where the water, before freezing, overflows upon the surface of the sheet or flows around the various dividers or partitioning mechanisms used for the removal of the ice so as to interconnect all of the cubes.

Furthermore, many of these mechanisms are relatively expensive, difficult to use, and often malfunction so that portions of the cubes break off while other portions remain frozen to the partitioning mechanisms. Thus, the present invention relates to an improved form of a so-called ice cube tray which comprises a relatively inexpensive, simplified, one-piece construction wherein individual pieces of ice may be removed on a one-by-one basis with little or no trouble or, in the alternative, a simple twisting motion will loosen all of the individual pieces for simultaneous removal.

SUMMARY OF THE INVENTION

The invention disclosed herein contemplates an ice "cube" tray having specially shaped pockets or cavities for allowing individual ice pieces to be removed on a one-at-a-time basis. Each cavity has a curved bottom portion generally shaped in a part circular arc, preferably a part-cylindrical configuration and a pair of generally concave opposed side walls of generally part-conical configuration whose central apices provide a pivot axis about which the ice piece rotates when pressure is applied to the end of the piece to slide the piece along the curved bottom portion for removal from the cavities. The sheet which interconnects the cavities should preferably be resiliently twistable to loosen all of the ice cubes simultaneously, if desired, and legs on the underside of the sheet may be provided with notches for engaging portions on the upper side of the sheet of another tray to facilitate compact tray stacking, one upon another, without tray slippage or interference with formation of the ice pieces.

In the preferred embodiment, the tray includes a substantially flat, horizontally arranged thin sheet having a number of spaced apart individual cavities integrally formed therein and depending therefrom. Each of the cavities is specially shaped and the top opening is generally hexagonal. The curvate shaped bottom portion is comprised of a part-cylindrical bottom wall in the preferred embodiment which integrally merges into opposed perimetral ends of the hexagonal top opening.

Each of the top openings has a longitudinal axis positioned between the opposite perimetral ends thereof and a transverse axis normal thereto. The longitudinal axis is normal to the longitudinal axis of the sheet. Each of the side walls of the cavities is concave and of opposite symmetry with the opposed central apices of each opening being parallel to the generating axis of the cylindrical bottom wall to define an axis about which the ice cube can be rotated for removal. This axis is parallel to the transverse axis and the transverse width of the opening measured along the pivot axis is a maximum while the transverse width measured across the ends of the opening which integrally merge with the bottom portion is a minimum.

The opposed part conical side walls extend uniformly upwardly and outwardly and centrally, measured in a vertical plane bisecting the cavity, the angle between each side wall and bottom wall approaches 105°.

The present construction is such that force applied to one end of an individual piece of ice will cause it to rotate about the axis and slide out of the cavity for easy individual removal from the tray. Alternatively, the sheet formed of a resilient material may be subjected to twisting pressure to loosen all of the ice pieces within the cavities for removal.

The ice tray of the present invention is preferably rectangular having a first axis corresponding to the longitudinal axis of the sheet and a second axis corresponding to the transverse axis of the sheet. The pockets are arranged in two parallel rows oriented along the longitudinal axis of the sheet such that the longitudinal axis of the individual top openings is parallel to the transverse axis of the sheet and the transverse axis of the top openings is parallel to the longitudinal axis of the sheet. The sheet may include a raised rim portion integral therewith and having the rim portion extending upwardly from the flat portion of the sheet and completely surrounding the sheet to contain liquid poured onto the sheet.

Furthermore, the sheet can be provided with apertures passing through the sheet and interiorly of the raised rim portion for draining excess liquid so that cavities may be filled but not beyond the flat upper surface of the sheet to preserve the individuality of the pieces of ice to be formed in the cavities.

The combination of the flat sheet and individual spaced cavities whose wall thicknesses throughout are thin and substantially uniform includes generally hourglass-shaped configurations between adjacent cavities. Notched channels may be provided in the sheet extending between the top openings of the cavities at their narrowest separations for allowing flow of liquid between adjacent cavities for levelling liquid throughout.

Additionally, the rim portion may be provided with reinforcing rib; additional reinforcement may be provided on the underside of the tray between individual pockets; and a pair of reinforcing support legs adjacent each end of the sheet may be provided. Further, the reinforcing support legs may include an elongated portion integral with the sheet and extending downwardly therefrom, and may further include a lower end portion having a means adapted to engage the narrow portion between adjacent openings on the surface of another tray for stacking purposes. This allows a plurality of trays to be compactly stacked one above the other and prevents tray slippage.

In the preferred embodiment of the present invention the curvature of the continuous cylindrical bottom wall is 180° with its axis of generation located between opposed apices of the side walls of the generally hexagonal top opening. The side walls are slightly bowed or concave uniformly upwardly since they are integral with the sheet and form a unitary continuous wall from the side wall portion of the opening to the 180° cylindrically curved bottom wall and make an angle of the order of 105° centrally and measured in a vertical plane.

The present invention contemplates a unitary structure which may be molded out of plastic material in a single piece and wherein water or other liquids may be easily poured into the pockets by even a child. The overflow drains from the sheet through the drain apertures and uniform pieces of ice are insured due to the levelling achieved by the notched openings between adjacent pockets. The individuality of the pieces is maintained and they may be removed one at a time with ease.

BRIEF DESCRIPTION OF THE DRAWINGS

These and other objects and advantages of the present invention will become more apparent upon reading the following detailed description, the claims and the attached drawings in which:

FIG. 1 is a perspective view of the ice tray of the present invention;

FIG. 2 is an elevational side view of the ice tray of FIG. 1;

FIG. 3 is a top view of the ice tray of FIG. 2;

FIG. 4 is an end view of the ice tray of FIG. 3;

DETAILED DESCRIPTION

Figure 5:
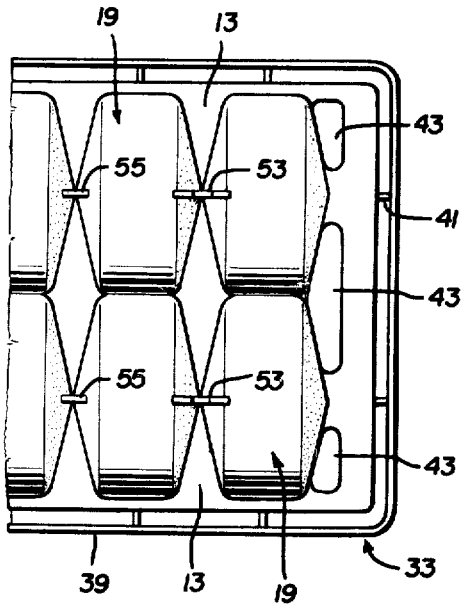
FIG. 5 is a bottom view of a portion of the ice tray of the present invention.

As shown in FIG. 1, the ice tray 11 is formed of a thin, substantially flat, horizontally arranged sheet 13 of relatively stiff plastic-like material of substantially uniform thickness throughout which can be twisted and bent resiliently upon the application of suitable manual forces and which will resiliently return to its original shape. A number of suitable plastics are commercially available for this purpose, such as some of the vinyl formulations, polyvinyl chlorides, etc. The particular plastic selected is within the realm of those skilled in the art.

Sheet 13 is generally rectangular in shape and has a first longitudinal axis 15 and a second transverse axis 17 which is perpendicular to the first mentioned axis 15.

A pair of parallel rows of individual cavities, compartments or cells are formed in the sheet 13 and arranged in parallel relation to the first axis 15. Each cavity 19 is adapted to receive water or other liquid to be frozen. Each cavity 19 presents a top opening 21 defined by the upper edges or margins of such cavity meeting the horizontally disposed interconnecting top wall portion, angularly and presents a degree of sharpness as revealed particularly by FIGS. 6 and 7 of the drawings and includes a continuously uniformly curved bottom wall portion 23 flanked by a pair of opposed concave side walls 25, of generally part conical configuration inclined upwardly and outwardly.

The top opening 21 of each of the cavities 19 has generally hexagonal perimetral configuration and each has longitudinal axis 27 and a transverse or width axis 29. A pivot axis 31 is parallel to the transverse axis 29 and perpendicular to the longitudinal axis 27 and is located across the central portion of the opening 21 between the opposed apices of the side walls 25. The pivot axis 31 longitudinally bisects the opening 21 and the transverse width of the top opening 21 measured along the pivot axis is the maximum width dimension (Wmax) of the top opening 21 while the transverse width measured parallel to the pivot axis at the ends of the opening 21 is a minimum width dimension (Wmin).

Pivot axis 31 in the preferred embodiment lies substantially in the plane of the top or access opening 21 which is coincident with the plane of the sheet 13 constituting the top wall of the ice tray.

Obviously by placing the pivot axis or center of curvature 31 in the plane of the top wall, a maximum volume of ice piece is achieved, whereby the bottom wall extends throughout 180°. If the pivot axis 31 should be placed in the region above the plane of the top wall, the angular extent of the bottom wall will be reduced below 180° whereby the volume of the ice piece will be diminished.

The length of top opening 21 measured along its longitudinal axis 27 is dimensionally greater than the maximum width dimension of the opening 21. The continuously curved bottom wall portion 23 is integral with the sheet 13 and extends downwardly from the opposite longitudinal end portions of top opening 21 in a continuous, generally circular arc having an axis of generation parallel to or coincident with pivot axis 31. In the preferred embodiment disclosed herein, the arc throughout extends 180° or thereabouts the bottom wall 23 is cylindrically shaped and has a transverse width no greater than the minimum transverse width (Wmin) of the opening 21.

Each of the pair of opposed side walls 25 is integral with the sheet 13 and extends downwardly from the sides of the top opening 21. Side walls 25 are generally uniformly concaved of part conical configuration tapering downwardly and inwardly until they become integrally merged with the continuously curved bottom wall 23.

Figure 7:
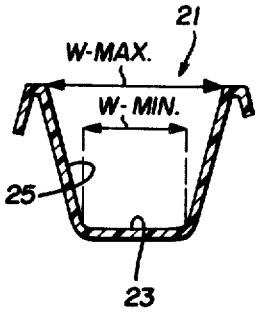
FIG. 7 is a schematic representation of a transverse view of one of the pockets of the ice tray of the present invention, to illustrate the dimensional relationships within the pocket.

The angle between each side wall and a bottom wall centrally thereof and measured in a vertical plane is of the order of 105° as may be seen in FIG. 7. This angle of 105° is substantially greater than 90° and is in contrast to small draft angles required for mould removal from dies as set forth in standard texts for specific materials.

It will also be readily understood that the bottom wall 23, being uniformly curvate and side walls 25 being uniformly part conical have an axis of generation coincident with pivot axis 31.

Figure 6:
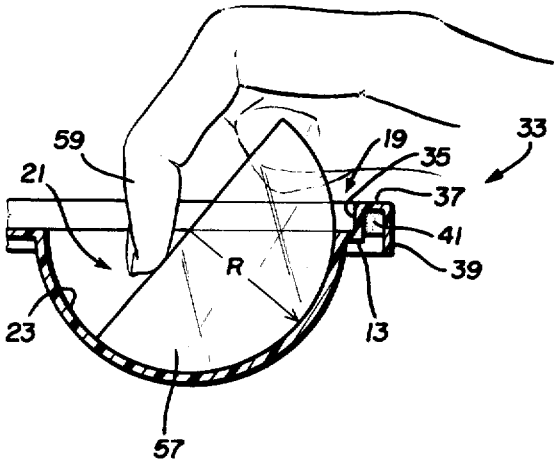
FIG. 6 is a schematic representation of the structure and operation of an individual ice pocket of the ice tray of the present invention.

As shown in FIGS. 1, 2 and 6, the ice tray 11 of the present invention also includes a raised rim portion 33 surrounding the sheet 13. The raised rim portion 33 is integral with the sheet 13 and includes a substantially vertical wall portion 35, a substantially horizontal top portion 37, and a downwardly extending flange portion 39. The substantially vertical wall portion 35 is generally normal to and integral with the sheet 13 and extends upwardly therefrom. The substantially horizontal top portion 37 is integral with the top part of the vertical wall portion 35 and is perpendicular thereto, and it extends away from the sheet 13 and is substantially parallel thereto. The downwardly extending flange portion 39 is integral with the top portion 37 and is substantially parallel to the vertical wall portion 37.

A plurality of spaced reinforcing ribs 41 are integral with the vertical wall portion 35, the horizontal top portion 37 and the flange portion 39 and extends therebetween for strengthening the tray 11.

Each of the sheets 13 is provided with one or more drain openings or apertures 43 so that water or other liquid poured onto the sheet 13 and generally directed thereon by the raised rim portion 33 will be directed through the openings 21 into the cavities 19. Any excess water over and above that required to fill the cavities 19 will be drained off of the top surface of the sheet 13 through the holes 43.

An hourglass-shaped configuration 45 exists between each adjacent pair of longitudinally arranged cavities 19 and a notched channel 47 may be provided across the narrowest portion of the hourglass configuration 45 to allow the flow of liquid between adjacent pockets to provide for level equalization between cavities.

As seen in FIG. 2, the ice tray 11 of the present invention may be provided with reinforcing support legs 49. Each of the legs 49 includes an elongated portion 51 which is integral with the underside of the sheet 13 and adjacent side walls 25, and each has a lower end adapted to support the tray level on a horizontal surface. Additionally, a notched portion 53 may be provided at the lower end of the elongated portion 51 for engaging the notched channels 47 or the thinnest portion of the hourglass configuration 45 between the adjacent pockets to allow one tray 11 to be positioned immediately above another tray 11 for compact stacking purposes. The leg portions 53 effectively interlock the compactly stacked trays to prevent slippage while insuring sufficient spacing to prevent interference with formation of ice pieces.

Additionally, FIG. 2 shows that a plurality of reinforcing rib-like members 55 may be provided between adjacent cavities 19. These members 55 are integral with the underside of the sheet 13 and the side walls 25 of adjacent pockets 19 for further strengthening the tray 11.

FIG. 6 shows how an individual piece of ice 57 presses downwardly with his finger 59 as indicated by the arrow of FIG. 6 causing the individual pieces of ice 57 to slideably rotate about its pivot axis or fulcrum apices 31. This causes the piece of ice 57 to be loosened from the pocket 19 and further finger pressure will slideably eject or remove the piece of ice 57 from the pocket 19.

Additionally, since the ice tray 11 is made from substantially rigid yet resilient plastic material and of generally thin uniform thickness throughout a manually applied twisting motion to opposite ends of the tray 11 will loosen all of the individual pieces of ice for simultaneous removal, if desired.

In operation, the user holds the tray 11 under a faucet or some similar source of water or liquid and the rim portion 33 insures that the liquid is directed onto the flat surface 13 and then through the openings 21 into the cavities 19. The notched apertures 47 between adjacent cavities insure level equalization of the liquid between pockets 19 when they are filled, and all excess water drains from the surface of the sheet 13 through the drain apertures 43.

The tray is then placed within the freezer compartment of the refrigerator and the liquid freezes within the cavities 19. As the liquid freezes, it will freeze over the top of the cavities. The last portion of the liquid to freeze will be a portion adjacent the bottom of the cavities. This last portion of the liquid as it freezes will expand the side walls of the cavities adjacent the bottom wall thereof.

When ice is desired, the user removes the tray from the refrigerator and, if all of the pieces of ice are desired, he grasps the tray at opposite ends and twists or slightly bends the tray. This force is transmitted from pocket to pocket via the sheet 13 and the rib-like members 55 thereby loosening each piece of ice from its own cavity or compartment 19. As each piece of ice is loosened from its own cavity, the expanded bottom portion thereof will cause the piece of ice to rise in its own cavity and will prevent the piece of ice from settling down into contact with the bottom wall due to engagement of the expanded portions of the piece of ice with the side walls of its cavity above the area of the side wall which it previously engaged on freezing. Thus, the pieces of ice are loose in the cavity and the cavity is not deformed. The piece of ice therefore remains loosened in its cavity after twisting of the ice cube tray which further promotes arcuate movement of the piece of ice and thus removal from the cavity.

If, on the other hand, the user desires a single piece of ice, he merely presses down on one end of a single piece of ice 57, as indicated in FIG. 6, causing it to rotate about its pivot axis 31 for easy individual removal from the cavity 19.

With this detailed description of the prime embodiment of the present invention, it will be obvious to those skilled in the art that various modifications may be made in the structure of the ice tray of the present invention without departing from the spriit and scope of the present invention which is limited only by the appended claims.

What I claim as my invention is:

1. In an ice tray of resilient plastic, a plurality of spaced apart cavities, each said cavity being defined by several intersecting walls including a bottom wall presenting two spaced apart opposed end edges uppermost flanked by a pair of side walls, each said side wall being inclined upwardly and outwardly from the intersection with said bottom wall at an angle ranging between a lower value substantially greater than 90° exceeding a draft angle required for mould withdrawal up to about 105°, and presenting side edges uppermost which merge with said spaced, opposed end edges of said bottom wall to define the perimeter of the cavity opening, a wall formation extending between said cavities in the region of their uppermost edges to integrally interconnect and support same in spaced apart tray defining relation, said cavity walls and uppermost wall formation having a substantially constant thickness throughout their extent and of a stiffness and resiliency to substantially maintain cavity shaping under freezing and thawing conditions, the internal configuration of each said cavity walls having a common axis of revolution uppermost and an angular extent with reference to said axis of revolution not exceeding 180°.

2. An ice tray according to claim 1 in which said cavity is defined by a centrally located bottom wall of part cylindrical configuration flanked by uniformly spaced opposed concave part-conical side walls of opposite symmetry.

3. An ice tray according to claim 1 in which the perimeter of said access opening has a substantially hexagonal configuration.

4. An ice tray according to claim 1 in which said tray is comprised of a body of stiff resilient plastic material.

5. In a mould of resilient plastic for producing pieces of ice or the like, a plurality of spaced apart individual cavities, each cavity being defined by a plurality of intersecting walls presenting an access opening including two spaced apart opposed end edges adapted to be located uppermost and with said intersecting walls lying within the downward projection of the perimeter of said access opening, said cavities being united at their upper perimeters defining said access opening into an integral unit, said intersecting walls having a substantially uniform thickness and stiffness throughout their extent and a resiliency sufficient to accommodate the expansion of water to be deposited and frozen therein, the internal configuration of the walls of each said cavity having a common axis of revolution and an angular extent not exceeding 180° including a centrally located concave bottom wall flanked by uniformly spaced opposed concave part-conical side walls sloping upwardly and outwardly from the intersection of said side walls with said bottom wall to the perimeter of said access opening, each said side wall being inclined upwardly and outwardly from the intersection with said bottom wall at an angle ranging between a lower value substantially greater than 90° exceeding a draft angle required for mould withdrawal up to about 105°, and presenting side edges uppermost which merge with said spaced, opposed end edges of said bottom wall to define the perimeter of the access opening, each said cavity presenting a plane of symmetry coincident with said axis of revolution and which includes the apices of said concave part-conical side walls.

6. In a mould for producing pieces of ice or the like, a tray formation of resilient plastic consisting of a body of relatively thin stiff resilient material of generally uniform thickness throughout, said body including a top wall portion having a plurality of individual cavities depending therefrom, each cavity being defined by a plurality of walls spaced from the walls of adjacent cavities and each cavity presenting an access opening including two spaced apart opposed end edges uppermost at the intersection of said cavity walls with the top wall portion of said body, said cavity walls including an upwardly concave bottom wall extending in one direction and flanked by upwardly and outwardly sloping uniformly spaced opposing concave side walls, each said side wall being inclined upwardly and outwardly from the intersection with said bottom wall at an angle ranging between a lower value substantially greater than 90° exceeding a draft angle required for mould withdrawal up to about 105°, and presenting side edges uppermost which merge with said spaced, opposed end edges of said bottom wall to define the perimeter of the access opening, each said cavity having a width measured in a direction along an axial center line bisecting said spaced opposed concave side walls and generally lying in the plane of the top wall portion thereof greater than the width of any other portion of said cavity measured in said aforementioned direction, the center of curvature of said upwardly concave bottom wall being substantially coincident with said aforementioned axial center line, and the perimeter of each said access opening having a generally hexagonal configuration whereby each piece of ice to be moulded therein is supported for rotative displacement about said axial center line out of said access opening at one side of said axial center line thereof under the application of forces to such moulded piece of ice at the other side of said axial center line.

7. A mould according to claim 6 in which each said cavity is defined by a centrally located bottom wall of part-cylindrical configuration flanked by uniformly spaced side walls of part-conical configuration of opposite symmetry.

8. A mould according to claim 6 in which said tray formation is generally rectangular in plan with said cavities arranged in parallel rows and uniformly oriented along a longitudinal axis thereof.

9. A mould according to claim 6 in which said top wall portion includes an integral peripheral raised rim portion extending upwardly from the perimeter of said top wall portion and surrounding and enclosing said access openings of said spaced apart cavities therewithin.

10. A mould according to claim 6 in which said top wall portion includes an integral peripheral raised rim portion extending upwardly from said top wall portion, said peripheral raised rim portion including a first inner vertical wall portion extending substantially normal to the plane of said top wall portion, a second horizontally oriented upper wall portion integral with the uppermost extent of said first mentioned inner vertical wall portion and extending outwardly away from said top wall portion and a third downwardly extending flange portion integral with the outermost extent of said second mentioned horizontally oriented upper wall portion to define therewith a peripherally extending downwardly opening channel formation and a plurality of spaced integral reinforcing ribs registered within said peripheral channel formation and bridging same for strengthening said body of material.

11. A mould according to claim 6 in which said top wall portion is provided with a plurality of upwardly opening channel formations extending between the upper peripheries of adjacent cavities and below the upper surface of said top wall portion whereby water from one cavity can flow to an adjacent cavity to establish a common liquid level.

12. A mould according to claim 6 in which said tray formation is provided with opposed pairs of reinforcing support legs adjacent each end thereof, each said leg extending substantially vertically downwardly from the underside of said tray formation and integral with said body of material, the lowermost portion of said pairs of said support legs extending horizontally and longitudinally of said tray and presenting an edge configuration therebelow adapted to engage with projections presented by a next like lower tray formation, whereby said tray formations may be stacked one upon the other.

13. In an ice tray of resilient plastic for forming a plurality of individual pieces of ice comprising a stiff resilient plastic sheet having a plurality of individual pockets therein presenting access openings uppermost for receivably retaining water or the like to be frozen, said pockets being integral with said sheet and extending downwardly therefrom, each said pockets including a bottom wall and two opposed uniformly spaced apart side walls of substantially uniform thickness throughout their extent, each said side wall being inclined upwardly and outwardly from the intersection with said bottom wall at an angle ranging between a lower value substantially greater than 90° exceeding a draft angle required for mould withdrawal up to about 105°, said bottom wall presenting uppermost opposed spaced apart end edges of like extent, and said spaced apart side walls presenting uppermost opposed spaced apart side edges merging with said end edges to define the perimeter of said access opening for said pocket, said bottom wall being a single substantially part circular arc to define an upwardly concave part-cylindrical sliding surface and said side walls being concave with the widest separation thereof located centrally between said end edges and substantially in the plane of the perimeter of said access opening to define a central pivot axis substantially coincident with the axis of generation of said part-cylindrical sliding surface, said side walls intersecting with said bottom wall at a contained angle greater than 90° and said side walls and bottom wall of each said pocket being spaced from the side walls and bottom walls of adjacent pockets.

14. An ice tray according to claim 13 in which said tray has a longitudinal and a transverse axis and in which said pockets have like dimensions which include longitudinal and transverse axes, said pockets being arranged in two rows with their transverse axes aligned in each row and arranged in parallel relation to the longitudinal axis of said tray, the upper surface of said plastic sheet located between said aligned pockets presenting shallow upwardly opening channels extending between the upper peripheries of adjacent pockets in each row and substantially centrally of adjacent side edges thereof and an outer peripheral rim integral with said plastic sheet upstanding therefrom having a generally U-shaped downwardly opening cross-section, said plastic sheet having an opening therethrough adjacent each end thereof and located between said pockets and said aforementioned outer peripheral rim.

15. An ice tray of resilient plastic material having at least one individual pocket therein for receiving water to be frozen wherein said pocket presents an access opening including two spaced apart opposed end edges which access opening is adapted to be located uppermost and having a generally hexagonal perimetral configuration which is symmetrical about a transverse axis lying substantially in the plane of said access opening and has a bottom wall flanked by inclined side walls lying within the downward projection of the perimeter of said access opening, each said side wall being inclined upwardly and outwardly from the intersection with said bottom wall at an angle ranging between a lower value substantially greater than 90° exceeding a draft angle required for mould withdrawal up to about 105°, and presenting side edges uppermost which merge with said spaced, opposed end edges of said bottom wall to define the perimeter of the access opening, said bottom wall and side wall configuration being defined by pivoting either symmetrical portion of the perimeter of said access opening about said transverse axis an angular extent of the order of 180°, said bottom wall and side walls of said pocket having a substantially uniform thickness throughout their extent.

16. An ice tray according to claim 15 wherein the lines of intersection of the bottom wall of said pocket with the spaced side walls of said pocket are parallel and said bottom wall is linear in a direction perpendicular to said lines of intersection.

17. An ice tray as set forth in claim 15 wherein the angle between said bottom wall and said side walls of said pocket is substantially greater than 90°.

18. In a mould of resilient plastic for producing pieces of ice or the like, a cavity having a top access opening including spaced end edges and spaced side edges, said cavity being defined by a bottom wall flanked by spaced concave side walls and of resilient plastic of substantially uniform thickness throughout their extent, said bottom wall extending downwardly uniformly curvately from said spaced end edges and said concave side walls extending downwardly uniformly inwardly of said respective side edges and merging respectively with said bottom wall along spaced parallel lines of intersection, each said side wall being inclined upwardly and outwardly from the intersection with said bottom wall at an angle ranging between a lower value substantially greater than 90° exceeding a draft angle required for mould withdrawal up to about 105°, and presenting side edges uppermost which merge with said spaced, opposed end edges of said bottom wall to define the perimeter of the access opening, said bottom and side walls having a configuration such that each wall is generated about a common axis of revolution lying substantially in the plane of the top access opening, said cavity having a substantially vertical plane of symmetry including said axis of revolution and in which the dimension of said cavity measured in the plane of said access opening and in the direction of said axis of revolution is at a maximum in the region of said axis of revolution.

19. A mould according to claim 18 in which the maximum dimension of said cavity measured in the plane of said access opening and in the direction of said axis of revolution is coincident with said axis of revolution.

20. A mould according to claim 18 in which said cavity has a second vertical plane of symmetry at right angles to said first mentioned plane of symmetry.

21. A mould according to claim 18 in which a plurality of like cavities are defined within a unitary structure and in which said side walls and bottom walls of each said cavity are separate and distinct from the side walls and bottom walls of all other cavities of said unitary structure.

22. A mould according to claim 18 in which said walls are of substantially uniformly thin, stiff, resilient plastic material.

23. An ice tray of resilient plastic for forming a plurality of individual pieces of ice comprising a stiff resilient plastic sheet having a plurality of individual pockets therein, each pocket presenting an access opening uppermost for receivably retaining water to be frozen to form said pieces, each said pocket being integral with said sheet and each extending downwardly therefrom in spaced apart relation to one another, each of said pockets including a centrally located bottom wall flanked by two opposed spaced apart side walls and of a substantially uniform thickness throughout their extent, said bottom wall terminating upwardly in two opposed spaced apart end edges of substantially equal extent defining part of the perimeter of said access opening and said opposed spaced apart side walls each terminating upwardly in spaced apart side edges which merge with said end edges to complete the perimeter of said access opening, said bottom wall being concave upwardly and having the configuration of a substantially part-circular arc, said end edges constituting a continuation of said part-circular arc of said bottom wall to thereby define a generally part-cylindrical sliding surface and said two opposed spaced apart side walls being concave and having the widest separation thereof located centrally between said end edges to form a central pivot axis substantially coincident with the axis of generation of said part-cylindrical sliding surface, each said side wall being inclined upwardly and outwardly from the intersection with said bottom wall at an angle ranging between a lower value substantially greater than 90° exceeding a draft angle required for mould withdrawal up to about 105°, and said pockets having like dimensions and longitudinal and transverse axes, with said pockets being located in two rows with their transverse axes aligned in each row and arranged parallel to the longitudinal axis of said tray, the longitudinal axis of each pocket being parallel to the transverse axis of said tray and the longitudinal axis of the pockets in one row being aligned with the longitudinal axis of the pockets in the adjacent row, said plastic sheet having upwardly opening channel means therein extending between adjacent pockets in each row substantially centrally of adjacent sides thereof, an outer peripheral rim integral with said tray and having a generally U-shaped downwardly opening cross-section, said tray having an opening therethrough adjacent each end thereof located between said pockets and said rim and said tray having stacking legs positioned between adjacent pockets and extending outwardly uniformly beyond the bottom thereof at each end of each row of said pockets.

24. An ice tray according to claim 23 in which the contained angles between the side walls and bottom wall are approximately 105°.

* * * * *